United States Patent [19]

Takeda

[11] Patent Number: 4,761,837

[45] Date of Patent: Aug. 9, 1988

[54] WASHING DEVICE FOR PARTS OF BODY

[75] Inventor: Hisanobu Takeda, Aichi, Japan

[73] Assignee: Aisin Seiki Kabushiki Kaisha, Kariya, Japan

[21] Appl. No.: 911,287

[22] Filed: Sep. 24, 1986

[30] Foreign Application Priority Data

Sep. 24, 1985 [JP] Japan ..... 60-210523

[51] Int. Cl.[4] ..... A47K 3/22; A61H 35/00

[52] U.S. Cl. ..... 4/443; 4/448; 4/420.1; 4/420.2; 4/420.4

[58] Field of Search ..... 4/420.2, 420.1, 443, 4/446, 447, 541, 542, 544, 543

[56] References Cited

U.S. PATENT DOCUMENTS

| | | | |
|---|---|---|---|
| 4,287,618 | 9/1981 | Silver | 4/420.2 |
| 4,411,030 | 10/1983 | Kawai et al. | 4/420.2 |
| 4,419,775 | 12/1983 | Ebert | 4/542 |
| 4,551,868 | 11/1985 | Kawai et al. | 4/443 |
| 4,564,961 | 1/1986 | Kaneko et al. | 4/443 |
| 4,581,779 | 4/1986 | Matsui et al. | 4/420.2 |
| 4,598,431 | 7/1986 | Nagai et al. | 4/420.2 |
| 4,602,391 | 7/1986 | Shepherd | 4/544 X |
| 4,617,688 | 10/1986 | Kuo | 4/420.2 |

*Primary Examiner*—Henry K. Artis

*Attorney, Agent, or Firm*—Sughrue, Mion, Zinn, Macpeak, and Seas

[57] ABSTRACT

A washing device for parts of body comprises a pump means to supply water from a water source under pressure and a nozzle means which spouts the pressurized water against the private parts of human body as a water jet. Since the pump means has an air intake port on the suction side, air foam is securely mixed in the water jet. Also, since an air control valve is provided in connection with the air intake port, the mixing ratio of the air in the water can be controlled by the air control valve.

4 Claims, 3 Drawing Sheets

WASHING DEVICE FOR PARTS OF BODY

BACKGROUND OF THE INVENTION

1. Field of the Invention

This invention relates to a washing device for use in a toilet capable of washing the user's anus or the like body parts.

2. Description of the Prior Art

When washing water is spouted from a washing nozzle of a washing device toward the private parts, too strong water jet stream may cause the user who is suffering from hemorrhoids to feel pain. Also, when used as a bidet, the water jet spouted from the nozzle is required to render a soft feeling. Japanese patent application published after examination (koukoku) No. 13688/1983 discloses a washing device which imparts a soft feeling to a water jet by mixing air into washing water to cause foaming.

As shown in FIG.5, the nozzle portion for spouting washing water includes a fixed nozzle and another nozzle attached to fit to the end of the fixed nozzle and having an air intake port. Namely, the washing device comprises a first nozzle portion 52 disposed at the bottom of a toilet seat 51, and a nozzle body 53 attached to the forward end of the first nozzle portion 52. Heated water spouted from the first nozzle portion 52 passes through a hollow passage 54 of the nozzle body 53, changes its flowing direction by the angle of 90° in the midway of the passage 54 and then, spouts from a nozzle hole 55 toward the private parts. In this case, since an air suction port 57 is provided near a nozzle hole 56 of the first nozzle portion 52, heated water sucks up the air and mixes air therein, and is spouted from the nozzle hole 55 of the nozzle body 53 as a foam.

In the conventional device, however, heated water from the first nozzle portion 52 impinges on and scattered at the bent portion of the passage 54 of the nozzle body 53, and then passes through the rest of the passage 54 and spouted out from the nozzle hole 55 of the nozzle body 53. Thus, when impinged on the bent portion of the passage 54, the water engulfs and mixes the air which is sucked from the air suction port 57. Accordingly, the mixing ratio of the air in heated water tends to be inaccurate and insufficient. Also, since the water injected from the first nozzle portion 52 is inpinges onto the bent portion of the passage 54 and then changes its direction, energy loss is caused to the water jet and it may sometimes result in insufficient amount of the water jet stream. Furthermore, an introduced air amount is determined by the shape of the air suction port 57 of the nozzle body 53, and accordingly the mixing ratio of the air cannot be controlled. Also because nozzles employed in this device are of fixed construction, change in design to retractable nozzles and swinging nozzles is difficult. In addition, since the entire design of the nozzle is complicated, the nozzle, when stained with some filth, is hard to be cleaned off.

SUMMARY OF THE INVENTION

The present invention contemplates to dissolve the abovementioned drawbacks of the conventional device.

It is an object of the present invention to provide a washing device which is capable of mixing air in a water jet securely to form a foam.

It is another object of the present invention to provide a washing device which is capable of controlling a mixing ratio of the air in a water jet.

To achieve the above objects, the washing device of the present invention comprises a pump means to supply water from a water source under pressure, and a nozzle means which spouts the pressurized water toward the private parts of human body as a water jet. The pump means is provided with an air intake port which is located at a suction side thereof for introducing air into the water jet to provide a foam.

Namely, the washing device of the present invention essentially comprises the pump means and the nozzle means. Water reserved in the water source is sucked by the pump means and supplied under pressure to the nozzle means, and then spouted as a water jet from an injection portion of the nozzle means toward the private parts. Since the water is preferred to be heated, especially in winter, it is desirable that a feed water heating device be provided between the water source and the pump means. The water source is constituted by a tank which can reserve water supplied by the water service and the like, and is provided with a ball tap or the like to keep the reservoir water to a predetermined amount. The feed water heating device has a heater at a bottom thereof, and the water supplied from the water source is heated by the heater portion of the feed water heating device. It is preferable that the feed water heating device be provided with a thermosensitive sensor to detect temperature of the water.

The pump means of the present invention can be of any type as long as it functions to supply water under pressure. It is preferable that a positive displacement pump such as a vane pump and a geared pump be employed because the function of such a pump is hardly damaged by the mixed air. The pump means sucks, through a pump inlet port, water directly from the water source or heated water which is heated by the feed water heating device, and at the same time discharges the water from a pump outlet port by means of rotation of the vane and the like. On the suction side, i.e., negative pressure side of the pump means, an air intake port is provided, and an air control valve is connected to the intake port. Namely, in the process that the heated water sucked from the pump inlet port is discharged from a pump outlet port by means of rotation of the vane, air is introduced into and mixed with the water at the air intake port on the suction side through the air control valve. The opening of the air control valve is made controllable manually or by means of a remote control unit so that the amount of air introduced from the air intake port can be regulated. In this case, the wider the opening of the air control valve becomes, larger the amount of air mixed in the washing water to form a foam jet.

Thus, the washing water is mixed with air and supplied to the nozzle means under pressure. Preferably the injection portion of the nozzle means is divided into two steps. For example, the injection portion of the nozzle means may comprise a first nozzle portion having a first nozzle, and a second nozzle portion having a second nozzle which is axially aligned with the first nozzle and has a larger diameter than the first nozzle. Between the first nozzle and the second nozzle may be provided an air pressure introducing chamber having an air intake port which communicates with the environmental air. In this case, the pressurized heated water containing air is spouted from the first nozzle of the first nozzle portion as a foam and at the same time injected into the air pressure introducing chamber to have the air pressure reduced. Therefore, rapid expansion of the air-water foam causes the heated water to scatter partially in the air pressure introducing chamber. The decompressed heated water is further spouted from the second nozzle of the second nozzle portion toward the private parts as a foamed jet of water. In this case, since the pressure is already reduced in the air pressure introducing chamber, the water reaches to the private parts without scattering.

According to the device of the present invention, as described in the above, the air is positively introduced from the suction side of the pump means when the water of the water source is supplied under pressure to the pump means and spouted from the nozzle means toward the private parts. Therefore, since the air is securely mixed in the water jet and the water jet containing the air is made foamy, a water jet to be spouted renders an extremely soft feeling to the user.

DETAILED DESCRIPTION OF THE PREFERRED EMBODIMENT

While the present invention shall now be descirbed with reference to the preferred embodiment shown in the accompanying drawings, the intention is not to limit the invention only to the particular embodiment but rather to include all modifications, alternations and equivalent arrangements possible within the scope of appended claims.

Figure 1:
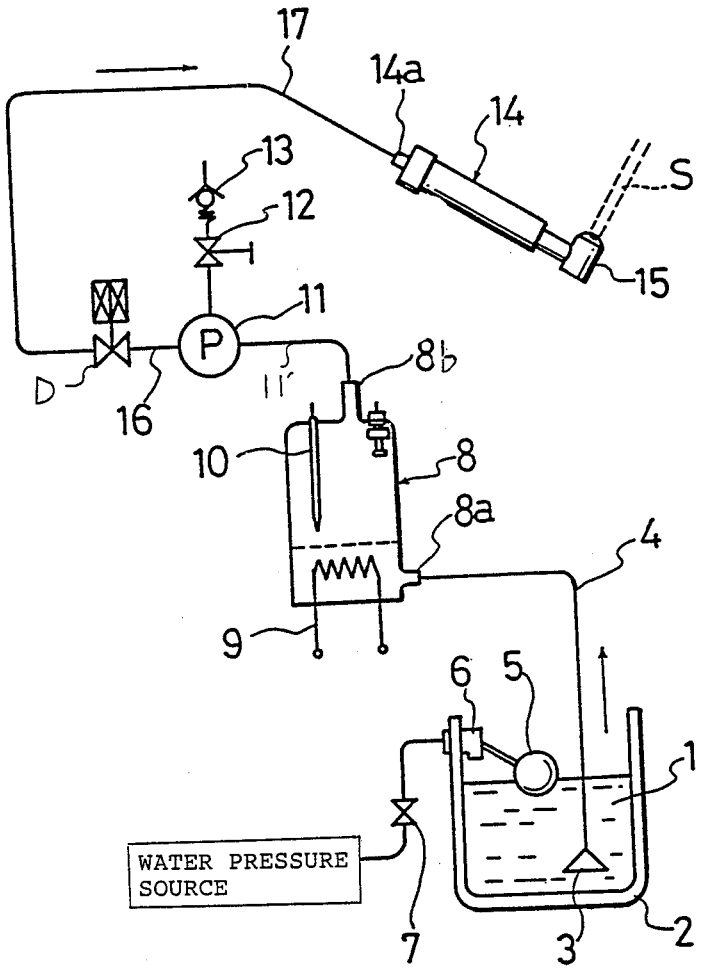
FIG.1 is a schematic flow diagram illustrating the entire waterway of the washing device of an embodiment according to the present invention.

Referring now to the drawing, particularly to FIG. 1, a water source 1 is for reserving and supplying the toilet bowl washing water installed in the lavatory. A ball tap 6 includes a valve for opening and closing feed water from a water pressure source in accordance with the motion of a float 5. A stop cock 7 is provided in the upper stream of the ball tap 6. Thus, a water tank 2 keeps a certain amount of water.

As shown in FIG. 1, a lower end of a water feed pipe 4 is provided with a filter 3, which is immersed in the water source 1. The other end of the water feed pipe 4 is connected to an inlet port 8*a* provided at the lower portion of a feed water heating device 8. The feed water heating device 8 is a sealed vessel and has a sheathed heater 9 at the bottom. Accordingly, the water supplied from the water feed pipe 4 to the feed water heating device 8 through the inlet port 8*a* is heated by the heater 9.

A thermosensitive sensor 10 is provided within the feed water heating device 8. Furthermore, an outlet port 8*b* is provided at the upper portion of the feed water heating device 8 and communicates with a pump means 11 by a suction pipe 11'.

Figure 2:
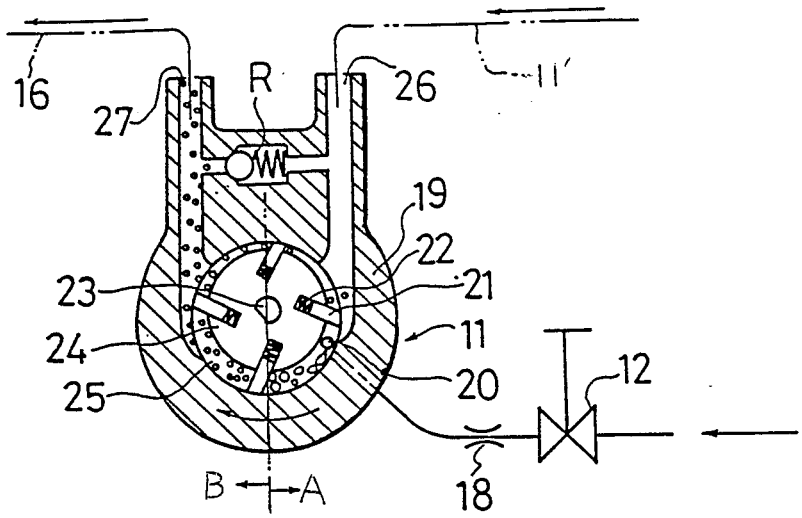
FIG. 2 is a cross-sectional view of a vane pump of the embodiment.

The pump means 11 is explained with reference to FIG. 2. The pump means 11 is constituted by a vane pump wherein a rotary chamber 25 is formed in a pump housing 19, and in a manner to communicate with the rotary chamber 25 an inlet port 26 and an outlet port 27 with upward openings are provided at the right and left of the drawing, respectively. The pump inlet port 26 is connected to the feed water heating device 8 through the suction pipe 11'. Within the rotary chamber 25, the axis 23 is provided eccentrically with the center axis of the rotary chamber 25, and a rotor 24 is fixed to the axis 23. Therefore, the rotor 24 can rotate within the rotary chamber 25 by the rotation of the axis 23, and the torque is transmitted from an outside motor and the like. At the periphery of the rotor 24 is provided a plurality of vanes 21 at regular intervals. The vanes 21 are urged outwardly by springs 22 against the outer periphery of the rotor 24, and the outer ends of the vanes 21 are in contact with the inner wall of the rotor chamber 25. When the rotor 24 rotates, the outer ends of the vanes 21 rotate in slidable contact with the inner wall of the rotary chamber 25. The rotation of the vanes 21 allows the heated water introduced from the pump inlet port 26 to be supplied under pressure between the vanes and discharged into the discharge pipe 16 through the pump outlet port 27.

An air intake port 20 is provided on the suction side A of the rotary chamber 25 and connected to an air control valve 12 through an orifice 18. Furthermore, a check valve 13 is connected to the other end of the air control valve 12. Accordingly, the air can pass through the check valve 13 and the air control valve 12 and flow into the rotary chamber 25 through the air intake port 20. Then, since the rotation of the vanes 21 causes the suction side A of the rotary chamber 25 to have a negative pressure condition, the air forcibly introduced from the air intake port 20 is mixed with the heated water and discharged from the pump outlet port 27 as a foam. The opening of the air control valve 12 is manually controllable and the opening can be controlled by preference. Letter R in FIG. 2 designates a relieve valve provided between the pump inlet port 26 and the pump outlet port 27.

Letter D in FIG. 1 designates a solenoid valve. By being operated in linkage with the motion of the vane pump the solenoid valve D can be regulated to supply the heated water, which is mixed with the air by the vane pump, to the nozzle means 14.

Numeral 17 in FIG. 1 designates a water supply pipe which connects the solenoid valve D with the nozzle means 14.

Figure 3:
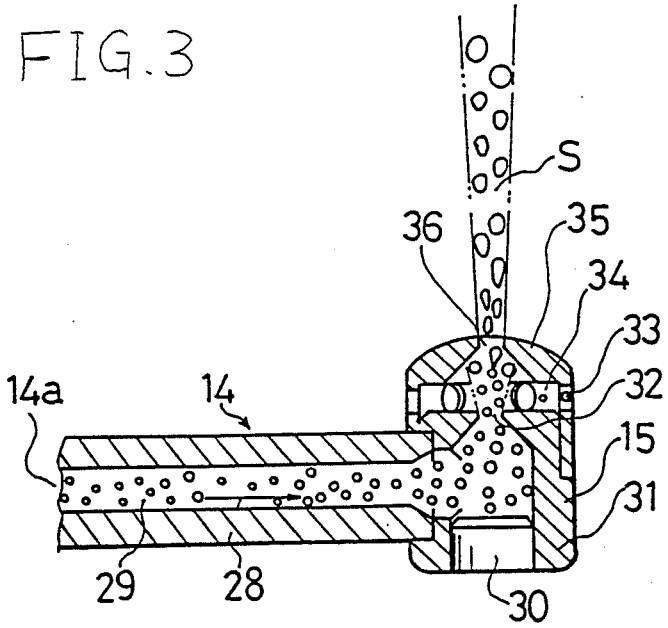
FIG. 3 is a cross-sectional view of the nozzle means of the embodiment.
Figure 4:
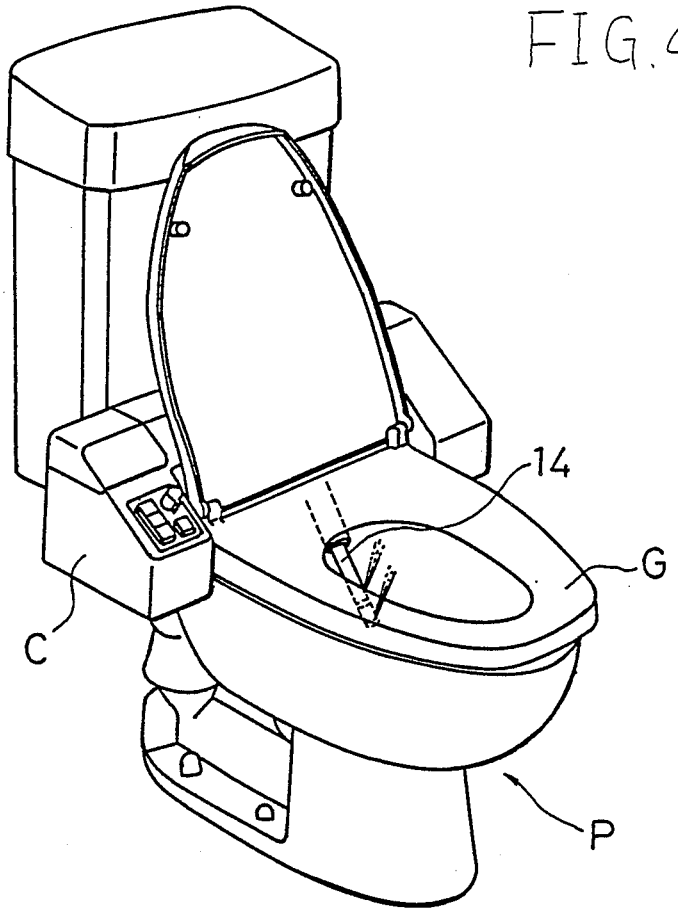
FIG. 4 is a perspective view of a washing device for parts of human body according to the present invention.
Figure 5:
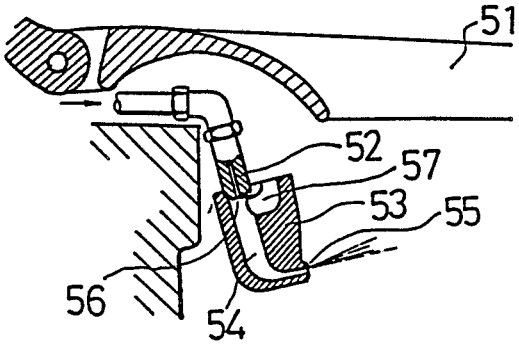
FIG. 5 (PRIOR ART)
FIG. 5 is a fragmentary sectional view of the nozzle portion of the conventional washing device.

Next, the nozzle means 14 is explained with reference to FIG. 3. The water supply pipe 17 is connected to an inlet port 14*a* of the nozzle means 14 and a nozzle pipe 28 has a through hole 29. An injection portion 15 is fixed at the other end of the nozzle 28. The injection portion 15 comprises a first nozzle portion 31 and a second nozzle portion 35 which is coaxially positioned on the first nozzle portion 31. The first nozzle portion 31 is fixed to and communicates with the forward end of the nozzle pipe 28. A stopper 30 is fitted into the bottom of the first nozzle portion 31 to define a cavity where a first nozzle 32 forms the upward narrowing sectional area. The second nozzle portion 35 is screw fitted into the upper portion of the first nozzle portion 31, while the second nozzle portion 35 has a cavity to form a second nozzle 36 with the upward narrowing sectional area. The second nozzle 36 is axially aligned with the first nozzle 32 and has a larger diameter than the first nozzle 32. The side wall of the second nozzle portion 35 has an air intake port 33. The air intake port 33 is positioned at the upper surface of the first nozzle portion 31 and forms the air pressure introducing chamber 34 between the upper surface of the first nozzle portion 31 and the inner circumferential wall of the second nozzle portion 35, that is, between the first nozzle 32 and the second nozzle 36. Accordingly, the heated air-water foam is ejected from the first nozzle 32 of the first nozzle portion 31 into the air pressure introducing chamber 34 where the water contacts with the air introduced through the air intake port 33, to have the air pressure reduced. Therefore, within the air pressure introducing chamber 34, the air-water foam in the pressurized heated water is expanded under the reduced pressure and causes the particles of the water to scatter into the different directions away from the private parts. The particles of the scattered heated water impinge on the inner wall of the cavity of the second nozzle portion 35, and are ejected with the main water jet from the second nozzle 36 of the second nozzle portion 35 toward the private parts as a controlled water jet. As shown in FIG. 4, the nozzle means 14 is disposed under the toilet seat G of the toilet bowl P, and the spouting water amount and the mixing ratio of the air in the water are controlled by the control means C mounted at the side of the toilet bowl P. Namely, the control means C is provided with the air amount control valve 12.

The function of the device of the embodiment is explained hereinafter. The water reserved in the water source 1 is sucked up from the water feed pipe 4 through the filter 3, and heated by the heater 9 within the feed water heating device 8. Then the heated water is supplied under pressure to the nozzle means 14 through the solenoid valve D by means of the heated water pump means 11. Within the pump means 11, the air is introduced to the air intake port 20 through the air control valve 12, to mix the air with the pressurized heated water. The mixing ratio of the air-water foam can be optionally controlled by regulating the air control valve 12. In the injection portion 15 of the nozzle means 14, the pressurized heated water containing the air is ejected as a foam from the first nozzle 32 of the first nozzle portion 31 into the air pressure introducing chamber 34 where the pressure of the water is reduced to the environmental air pressure and the air-water foam expands and reduces its pressure. The main water jet including the partial scattered heated water is spouted from the second nozzle 36 of the second nozzle portion 35 toward the private parts as a jet water S. Therefore, the water jet S can be directed only to the private parts with accuracy and is not scattered around. According to the washing device of the embodiment, the ratio of the air in the water jet S spouted from the nozzle means 14 is optionally controllable by regulating the air amount control valve 12 by preference. Also the water jet S to be spouted is directed only to the private parts with accuracy without scattering.

The washing device of the present invention can introduce the air through the air control valve within the pump means and easily make the water jet foamy by mixing the air in the heated water. In addition, since the air control valve can easily control the air introducing amount, the ratio of the air in the water can be controlled by preference. Also, since the air intake port provided in the pump means is simple in contruction, the pump means can be manufactured without increasing the cost. Besides, in case the user prefers hard washing without air foam, it can be achieved by closing the air control valve.

What is claimed is:

1. A washing device for parts of a body for use in combination with a toilet comprising:

water source means;

water heating means for heating water supplied from said water source means;

pump means having a suction side connected to said water heating means for sucking up the water heated by said water heating means and supplying the water under pressure;

said pump means having an air intake port provided in said suction side for introducing air into the water to form an air-water foam;

said air intake port of said pump means is connected to an air control valve having means for regulating the amount of air introduced into said pump means; and nozzle means connected to said pump means for ejecting the pressurized air-water foam toward parts of a body as a controlled jet.

2. A washing device for parts of a body according to claim 1, wherein said pump means is a positive displacement pump.

3. A washing device for parts of a body according to claim 1, wherein said nozzle means is comprised of first nozzle means having a first nozzle, a second nozzle means having a second nozzle axially aligned with said first nozzle and having a diameter larger than the diameter of said first nozzle, and an air pressure introducing chamber disposed between said first nozzle means and said second nozzle means in communication with environmental air for reducing the pressure of said air-water foam ejected from said nozzle means as a jet.

4. A washing device for parts of a body according to claim 2, wherein said positive displacement pump includes a chamber having rotary vein means therein and wherein said air intake port is disposed in communication with said chamber at the suction side of said pump.

* * * * *